United States Patent [19]

Schmidt

[11] Patent Number: 4,930,734

[45] Date of Patent: Jun. 5, 1990

[54] HOLDER FOR PLASTIC GROCERY BAGS

[76] Inventor: George M. Schmidt, 1901 Altura Dr., Corona Del Mar, Calif. 92525

[21] Appl. No.: 301,221

[22] Filed: Jan. 24, 1989

[51] Int. Cl.[5] ..... A63B 55/04

[52] U.S. Cl. ..... 248/97; 248/165

[58] Field of Search ..... 248/97, 99, 101, 165, 248/166, 150; 108/153, 154, 155; 211/189, 133; 403/377; 232/43.1, 43.2; 141/316, 390; 220/404

[56] References Cited

U.S. PATENT DOCUMENTS

| | | | |
|---|---|---|---|
| 1,570,532 | 1/1926 | Strouse et al. | 248/165 X |
| 3,737,129 | 6/1973 | Foster | 248/150 |
| 3,759,598 | 9/1973 | Limberger | 108/153 X |
| 4,308,964 | 1/1982 | Keller | 211/126 X |
| 4,403,554 | 9/1983 | Valentine | 211/189 X |
| 4,469,231 | 9/1984 | Hehn | 211/189 X |
| 4,638,968 | 1/1987 | Auten | 248/97 |
| 4,697,771 | 10/1987 | Majors | 248/97 |
| 4,723,743 | 2/1988 | Jenkins | 220/404 X |
| 4,744,612 | 5/1988 | Winter | 211/189 X |

FOREIGN PATENT DOCUMENTS

| | | | |
|---|---|---|---|
| 2828750 | 1/1980 | Fed. Rep. of Germany | 211/189 |

*Primary Examiner*—J. Franklin Foss

*Attorney, Agent, or Firm*—William L. Chapin

[57] ABSTRACT

A holder for maintaining flexible plastic bags, of the type having a pair of handle loops, in an open upright position useful as a trash receptacle includes a pair of thin, uniform cross-section end panels and at least one pair of thin, uniform cross-section side rails. Snap fasteners at each end of each side rail are provided to insertably receive the edge of an end panel, permitting a rectangular, open box-like structure to be constructed by the user, without tools, from a generally flat package of component parts. A cutout in the upper portion of each end panel has one or more downwardly projecting tabs formed in the upper edge wall of the cutout. Each handle loop of a flexible plastic bag placed in the open center of the holder may be looped over the upper edge wall of an adjacent end panel, and looped around a selected finger tab or tabs to retain the bag in an open, upright position within the holder.

19 Claims, 2 Drawing Sheets

HOLDER FOR PLASTIC GROCERY BAGS

BACKGROUND OF THE INVENTION

1. Field of the Invention

This invention relates to an article for holding flexible sacks. More particularly, the invention relates to an article for holding in an upright, open position, a grocery sack or bag of the type made from a flexible plastic film.

2. Description of Background Art

For many years, grocery stores, as well as other retail stores, packed goods purchased by the shopper in paper bags. Paper bags provided a convenient means for carrying groceries directly to the shopper's residence, or to his vehicle for the trip home.

Once the groceries were unloaded from the paper bags, the bags were useful as receptacles for accumulating garbage and other refuse in, prior to disposal of the refuse. For this purpose, the bags were used either standing alone, or inserted as liners into waste containers.

In relatively recent times, the ubiquitous paper grocery bag has begun to be replaced by bags made of a flexible plastic film. Plastic bags have been touted by large supermarkets and similar retail stores as being the wave of the future, and a great convenience to shoppers. Some shoppers have disagreed with that assessment, on the grounds that plastic bags are not biodegradable, as are paper bags, and that the plastic bags will not remain in an upright position in their cars.

However the relative merits of paper bags versus plastic bags are weighed, it seems clear that economic considerations apparently dictate that plastic bags will be dispensed with increasing frequency by stores, and that paper bags will become more scarce. It is equally clear that plastic grocery bags by themselves are not practically useable as trash receptacles, since they collapse into a limp pile when placed unsupported on the floor.

In apparent recognition of the desirability of having an article for holding plastic grocery bags in an upright, open position for use as a trash receptacle, a number of U.S. patents have issued for such articles. These include the following:

- Orem, 4,062,170, Dec. 13, 1977, Apparatus For Loading Bags.
- Swenson, 4,407,474, Oct. 4, 1983, Plastic Sack Holder.
- Hambleton, 4,437,634, Mar. 20, 1987, Plastic Sack Holder.
- Stroh, 4,467,989, Aug. 28, 1984, Collapsible Rack For Plastic Bags.
- Isgar, 4,567,310, Mar. 18, 1986, Container For Use With Plastic Bags.
- Prader, 4,623,111, Nov. 18, 1986, Wire Holder for Handled Plastic Bags.
- Brown, et al., 4,664,347, May 12, 1987, Trash Basket Having Integral Internally-Flush Vanes For Supporting Plastic Grocery Bags.
- Jenkins, 4,723,743, Feb. 9, 1988, Rack For Holding Paper And Plastic Grocery Bags.

The present invention was conceived of in response to a perceived need for an improved holder for plastic grocery bags.

Objects of the Invention

An object of the present invention is to provide an article for holding flexible bags or sacks in an upright position to facilitate use of the bags as trash receptacles.

Another object of the invention is to provide a holder for bags made of plastic film and having handle loops.

Another object of the invention is to provide a holder for flexible bags of simple and low-cost construction.

Another object of the invention is to provide a holder for plastic grocery bags which may be shipped knocked-down in a flat package, and readily assembled by the user.

Another object of the invention is to provide a light weight holder for plastic grocery bags which may be shipped knocked down in a flat package, and quickly and easily assembled without using any tools.

Various other objects and advantages of the present invention, and its most novel features, will become apparent to those skilled in the art by perusing the accompanying specification, drawings and claims. It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention described herein reasonably inferrable from that description be included within the scope of the invention as defined by the appended claims.

SUMMARY OF THE INVENTION

Briefly stated, the present invention comprehends an improved holder for flexible bags or sacks such as grocery bags made from plastic film. The holder is adapted to maintain a flexible bag in an upright position, with the mouth of the bag open, thus making the bag useful as a trash receptacle.

The bag holder according to the present invention is made of a number of thin, generally flat component parts fabricated from rigid plastic, wood or similar material, which parts may be stored and conveniently shipped in a flat parcel. The component parts may be quickly and easily assembled into a generally rectangular, open box-shaped frame, which may be used for holding flexible bags. This assembly may be performed by the homeowner or other user, without the use of any tools.

Two identical, generally rectangular-shaped end panels of the frame of the bag holder according to the present invention are each provided with two pairs of notches. One pair of notches extends inwards from the upper portion of the front and rear vertical edge walls.

Four identical, elongated rectangular flat rails each having bifurcated fasteners extending perpendicularly outwards from opposite short lateral ends of a rail are snapped into the notches in the end panels to form a frame having two parallel, vertically disposed, left and right end panels, two parallel, vertically spaced apart horizontally disposed front side rails perpendicularly joining the front edge walls of the left and right end panels, and two rear side rails identical in shape and vertical position relative to the front end rails joining the rear edge walls of the end panels.

The upper portion of each end panel is provided with a substantially large cutout area or perforation through the thickness dimension of the end panel. The upper edge wall of the cutout has downwardly protruding tabs or fingers adapted to engage the handle loops of plastic grocery bags. The bag holder is used by inserting a plastic grocery bag into the rectangular upper opening of the holder, and looping each handle loop of the bag up over the upper edge wall of a side panel and downwards and inwards around the handle-engaging tabs, thus holding the bag in an open, upright position within the holder.

DETAILED DESCRIPTION OF THE INVENTION

Referring now to FIGS. 1 through 6, a novel holder 10 for flexible bags such as plastic-film grocery bags is shown.

Figure 1:
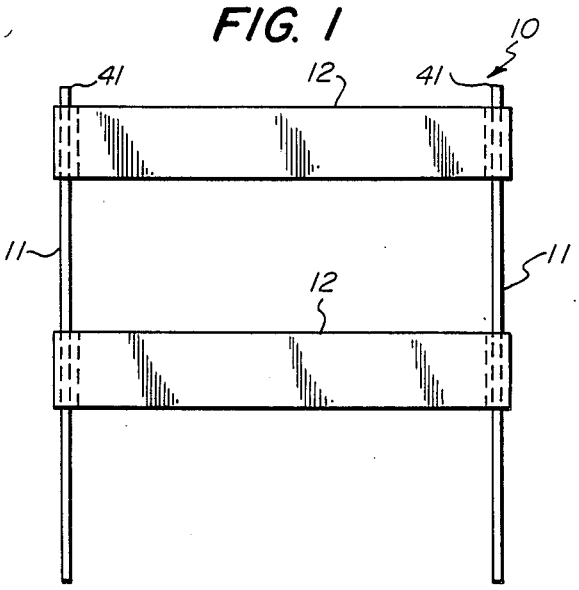
FIG. 1 is a front elevation view of a holder for plastic film bags according to the present invention.
Figure 2:
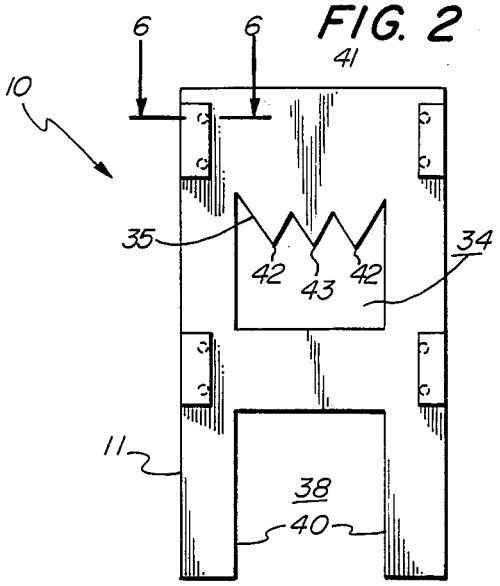
FIG. 2 is an end elevation view of the bag holder of FIG. 1.
Figure 3:
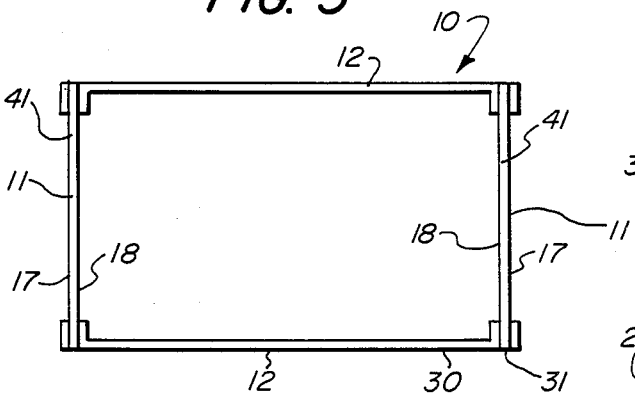
FIG. 3 is an upper plan view of the bag holder of FIG. 1.

As may be seen best by referring to FIGS. 1 through 3, the plastic grocery bag holder 10 according to the present invention includes two identical, generally thin, flat uniformthickness left and right end panels 11. The two end panels 11 are held in a laterally spaced apart, vertically disposed parallel alignment by two identical, horizontally disposed rectangular front side rails 12 fastened at their outer lateral ends to the side panels. The two front side rails 12 are parallel to one another, and vertically spaced apart to comprise an upper and lower side rail pair. Two rear side rails 12 identical to the front side rails, and in parallel, corresponding positions thereto, are attached at their outer lateral edges to the rear edges of the two end panels.

Left and right end panels 11 may be fabricated from any suitable rigid material, such as uniform thickness sheets of plastic, wood, heavy cardboard or the like.

Figure 4:
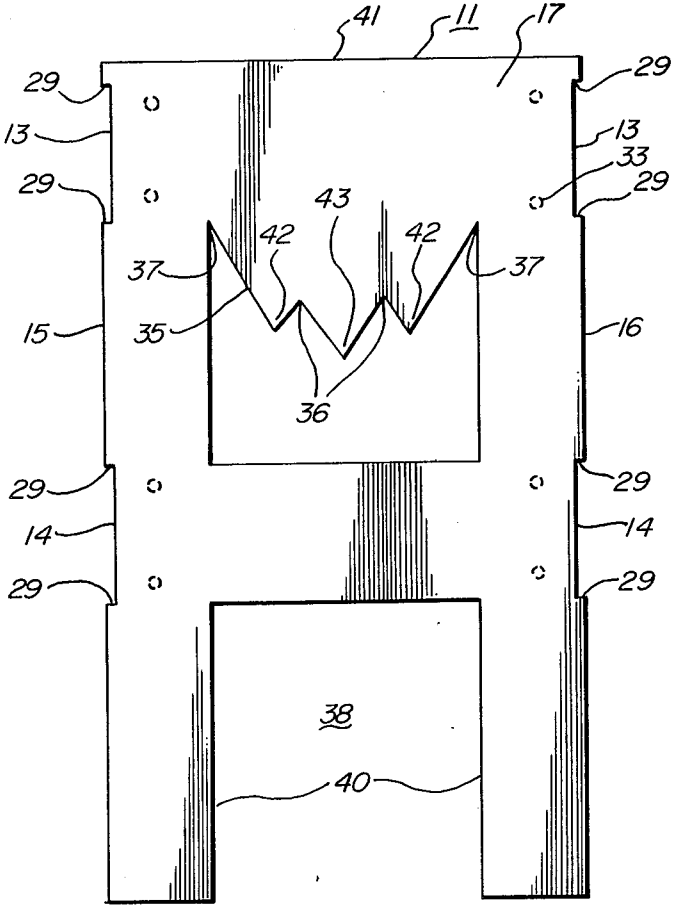
FIG. 4 is a plan view of one of the two identical end panels of the bag holder of FIG. 2, on a somewhat enlarged scale.

As may be seen best by referring to FIG. 4, end panels 11 have an upper pair and a lower pair of rectangular notches 13 and 14, respectively, extending inwards from the front and rear edge walls 15 and 16, respectively, of each end panel. The notches 13 and 14 are provided for lockingly receiving the outer lateral ends of front and rear side rails 12, as will be described later.

As shown in FIGS. 3 and 4, end panels 11 are of uniform thickness. Also, since all of the perimetral wall surfaces of the end panels 11 are perpendicular to the outer and inner planar surfaces 17 and 18 of each end panel, the end panels may be die cut, if fabricated from materials adapted to die cutting. End panels 11 may also be injection molded from a plastic such as ABS.

Figure 6:
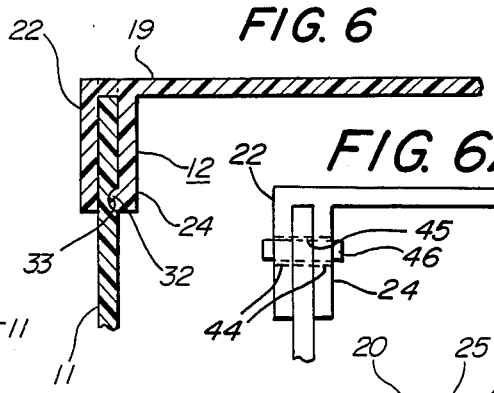
FIG. 6 is a fragmentary sectional view of the bag holder of FIG. 1, showing how a laterally disposed rail interlocks with an end panel thereof.
Figure 5:
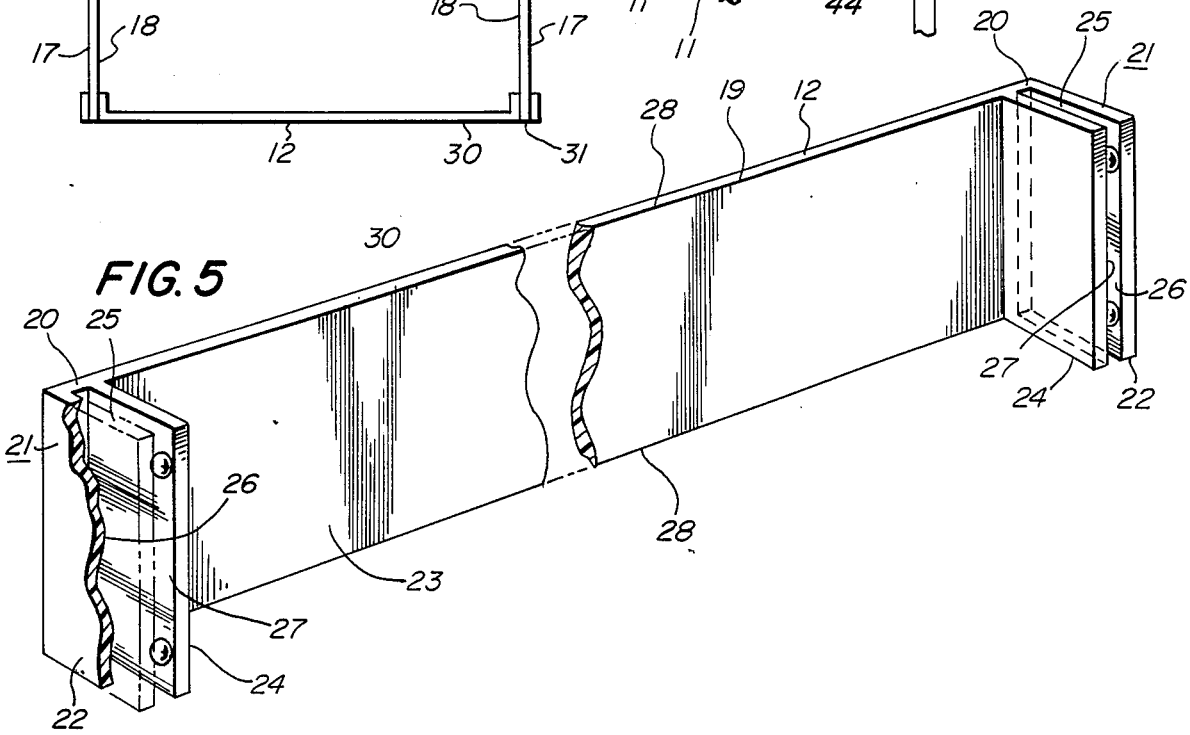
FIG. 5 is a perspective view of one of the four identical laterally disposed rails of the bag holder of FIG. 1.

As may be seen best by referring to FIGS. 5 and 6, front and rear side rails 12 are made of thin, laterally elongated, rectangular panels 19 of uniform thickness. The panels 19 may be fabricated from any suitable rigid material capable of being fabricated as elongated flat sheets, including plastic, wood, masonite or presswood, or even heavy cardboard.

Each rail 12 has at both opposite short lateral ends 20 means for fastening that end of the rail to an upper notch 13 or lower notch 14 of an end panel 11. In a preferred embodiment, the means for fastening the ends of rails 12 to end panels 11 comprises a bifurcated flange section 21 extending perpendicularly inwards from the plane of panel 19, at the outer lateral edge 20 of each rail.

As may be seen best by referring to FIG. 5, each bifurcated flange section 21 includes an outer leg 22 of generally rectangular shape and uniform thickness, which extends perpendicularly inwards flush with the outer edge wall 20 of a rail 12. Outer leg 22 spans the full height of the outer edge wall 20 of a rail 12, and extends perpendicularly rearwards a short distance from the rear surface 23 of the rail panel 19.

The bifurcated flange section 21 also includes an inner leg 24 having a shape and size substantially similar to outer leg 22. Inner leg 24 extends perpendicularly rearwards a short distance from the rear surface 23 of the rail panel 19, parallel to outer leg 22 and spaced apart laterally inwards a short distance from the outer leg 24. Thus an elongated rectangular space 25 is formed between the inner wall face 26 of outer leg 22, and the outer wall face 27 of inner leg 24 of bifurcated flange section 21.

The distance between inner wall face 26 of outer leg 22 and outer wall face 27 of inner leg 24 is preferably slightly less than the thickness of end panels 11. This allows the end panel 11 to be inserted edgewise into a bifurcated flange section 21, and held in place by an interference fit between the inner and outer legs of the flange section.

Also, as shown in FIGS. 1 and 2, the height of the short lateral edges 20 of the rails 12 is slightly less than the height of notches 13 and 14 in end panels 11. This dimension difference allows clearance between the upper and lower longitudinal edges 28 of the rails 12 and the upper and lower horizontal walls 29 of notches 13 and 14, permitting the rails to be pushed into the notches. Desirably, the depth of notches 13 and 14 is the same as the thickness of end panels 19 of each rail 12, so that when the rail is pushed all the way down into a notch, the front surface 30 of the rail panel is flush with the vertical edge surfaces 31 of the end panels.

In the preferred embodiment of holder 10, at least one, but preferably both inner leg 24 and outer leg 22 of the bifurcated flange section 21 is elastically deformable in a direction perpendicular to their facing wall surfaces 27 and 28, respectively. Elastic deformability of inner leg 24 and/or outer leg 22 of rails 12 results in their exerting a compressive pressure on the front and rear surfaces of end panels 11 when the notches 13 or 14 of the end panels are inserted between the legs to lockingly engage an end panel with a rail 12. Fabricating each side rail 12 as a one-piece injected molded plastic part, made of ABS, for example, incorporates sufficient elasticity into inner leg 24 and outer leg 22 of bifurcated flange section 21 of the rail to accomplish the desired compressive interlocking capability of the rail with an end panel.

Figure 6A:
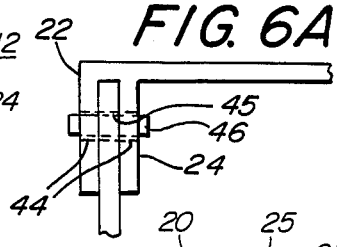
FIG. 6A is a fragmentary sectional view of an alternate means for interlocking a laterally disposed rail with an end panel.

As shown in FIGS. 5 and 6, each inner leg 24 of bifurcated flange section 21 of a rail 20 may be provided with one or more small vertically aligned rounded protuberances 32 extending outwards from the outer wall face 27 of the inner leg. The protuberances are adapted to insertably engage complementarily shaped and positioned dimples 33 formed in the inner surface wall 18 of each end panel 11. Locking engagement between protuberances 32 and dimples 33 insures that each rail 12 is properly positioned relative to an end panel 11 when the two are snapped together in the process of assembling a holder 10. In an alternate embodiment, shown in FIG. 6A, holes 44 and 45 may be provided in place of protuberances 32 and dimples 33 respectively, the holes being adapted to receive in an interference fit securing pins 46.

As may be seen best by referring to FIGS. 2 and 4, end panels 11 are provided with means for receiving and holding the handle loops of plastic film grocery bags. Thus, cutouts 34 are provided through the thickness dimension of the upper portion of end panels 11, the upper edge wall 35 of the cutout containing upwardly protruding inner notches 36 and outer notches 37 around which short or long handle loops, respectively, of a plastic grocery bag may be hooked.

As may be seen best by referring to FIGS. 2 and 4, the lower portion of each end panel 11 may contain a rectangular cutout section 38 extending upwards from the bottom horizontal edge wall 39 of the end panel, forming a pair of elongated rectangular support legs 40, one on each side of the cutout.

Figure 7:
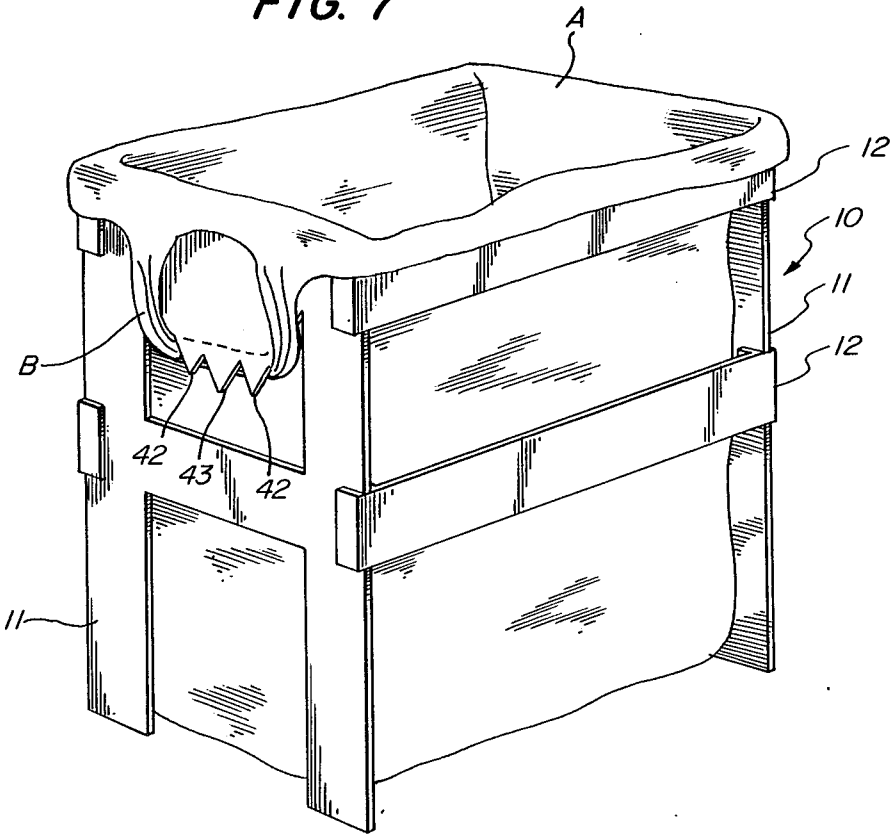
FIG. 7 is an upper perspective view of the bag holder of FIG. 1 showing how a plastic bag is secured within the holder in an upright, open position.

FIG. 7 illustrates how a flexible plastic film grocery bag A having handle loops B extending upwards from opposite upper sides of the bag may be placed into holder 10. The handle loops 10 are then folded over the upper edge walls 41 of end panels 11, and around outer fingers 42, or central finger 43, protruding downwards from the upper edge wall 35 of cutout 34, into notches 36 or 37, thus securing the bag in an upright, open position within holder 10.

What is claimed is:

1. A holder for supporting flexible bags in an upright position with the mouth of the bag in an open position, said holder being assembleable without separate fastening means or tools and comprising:

a. a pair of relatively thin end panels of generally uniform thickness and uniform cross-sectional shape, b. At least one pair of elongated relatively thin side rails of generally uniform thickness, and c. Means for releasably fastening opposite lateral ends of a first one of said side rails to a separate one of said end panels at a front edge of said end panel, and, a second one of said side rails to said end panels at the rear edges thereof, in a similar position to said first side rail, said first and second side rails being perpendicular to said end panels and thereby forming a rectangular plan view open space between the inner surfaces of said end panels and said side rails for receiving a flexible bag, and d. Means for releasably fastening said bag in an open position to said holder, e. Wherein said means for releasably fastening an opposite lateral edge of a side rail to an edge of an end panel comprises an elastically deformable, bifurcated member extending perpendicularly inwards from an edge of said side rail, said bifurcated member having adjacent flange sections with a space therebetween for insertably receiving in an interference fit said edge of said end panel.

2. The holder of claim 1 wherein said means for releasably fastening said bag in an open position to said holder comprises in combination a pair of flexible handle loops extending upwards from said upper edge of said mouth of said bag, one each of said handle loops on opposite sides of said bag, and means for fastening a separate one of said handle loops to a separate one of said end panels.

3. The holder of claim 2 wherein said means for fastening a separate handle loop to an end panel comprises a perforation through the thickness dimension of said end panel forming at least one pair of upwardly inwardly tapering notches adjacent a downwardly protruding finger about which a handle loop may be hooked.

4. The holder of claim 1 further including registered holes through said bifurcated member and said panel adapted to insertably receive a cylindrical fastening pin.

5. The holder of claim 1 wherein said end panels are further defined as having a pair of notches extending inwards from both front and rear edges of said panel, said notches being adapted to insertably receive said flange sections.

6. The holder of claim 1 wherein said bifurcated member is further defined as comprising a pair of thin, generally uniform thickness plates extending perpendicularly outwards from a flat rear face of said side rail, said plates comprising an outer plate positioned substantially flush with the outer lateral edge of said end rail, and an inner plate parallel with said outer plate and spaced laterally inwards therefrom to form a rectangular insertion space of slightly smaller thickness than the thickness of said end panels, at least one of said plates being elastically deformable to provide a compressive gripping force on said end panel when the latter is inserted into said insertion space.

7. The holder of claim 6 wherein said bifurcated member is further defined as being a one-piece molded plastic part.

8. The holder of claim 7 wherein said side rail is further defined as being a one-piece molded plastic part.

9. The holder of claim 8 wherein said end panels are further defined as each having a pair of notches extending inwards from both the front and rear edges of said panel, said notches each being adapted to insertably receive a separate one of said flange sections of said side rails.

10. A holder for supporting flexible bags in an upright position with the mouth of the bag in an open position, said holder being assemleable without separate fastening means or tools and comprising:

a. first and second end panels, each of said end panels being made of relatively thin, uniform thickness and uniform cross-sectional shape rigid material having in plan view the general shape of an elongated rectangle having a horizontal bottom surface and parallel vertical front and rear side surfaces, said end panels having means for engaging handle lops of said bags, and b. a first pair of front and rear side rails, each of said side rails being made of relatively thin, uniform crosssection, rigid material having in plan view the general shape of an elongated rectangle, the outer, short lateral edge of each of said side rails having a bifurcated flange section protruding perpendicularly outwards from a flat face of said side rail, said bifurcated flange section being adapted to insertably engage and grip an edge of one of said end panels, whereby the front side walls of said first and second end panels may be inserted into said bifurcated flange sections on opposite ends of a first, front one of said side rails, and the rear edge walls of said first and second end panels may be inserted into said bifurcated flange sections on opposite ends of a second, rear one of said side rails to form an open container having parallel front and rear walls and parallel side walls perpendicularly disposed to said front and rear walls.

11. The holder of claim 10 further including registered holes through said bifurcated member and said panel adapted to insertably receive a cylindrical fastening pin.

12. The holder of claim 10 further including a second pair of front and rear side rails similar to said first pair of side rails, said second pair front and rear side panels being fastened to said end panels in parallel alignment with said first pair of said front and rear side rails.

13. The holder of claim 12 wherein the front and rear edge walls of said end panels have a generally rectangular-shaped notch cut inwards therefrom at each location intended for insertion into a bifurcated flange section at an end of a said side rail, said notch being of sufficient height to allow clearance between the upper and lower edges of said side rails.

14. The holder of claim 13 wherein said means for engaging handle loops of said bags comprises at least one downwardly protruding finger tab formed in the upper wall surface of a perforation cut through the upper portion of each of said end panels, whereby the handle loops on each side of a bag placed within the holder may be looped over the upper edge wall of an adjacent end panel, and looped around said finger tab, thereby securing said bag in an upright position within said holder.

15. The holder of claim 14 wherein each of said end panels has extending upwards from its bottom horizontal wall surface a substantially large, generally rectangular-shaped notch, forming between the outer edge wall of each notch and the adjacent outer edge wall of said end panel an elongated, leg-like section.

16. The holder of claim 10 wherein said bifurcated flange section is further defined as comprising two generally rectangular plates in parallel close alignment forming a rectangular space therebetween for receiving in an interference fit an edge of a said end panel.

17. The holder of claim 16 wherein in at least one of said rectangular plates is elastically deformable away from an adjacent plate.

18. The holder of claim 17 wherein said bifurcated flange section is a one-piece molded plastic part.

19. The holder of claim 17 wherein each of said side rails is a molded plastic part.

* * * * *